US007849808B2

(12) United States Patent
Duquette et al.

(10) Patent No.: US 7,849,808 B2
(45) Date of Patent: Dec. 14, 2010

(54) PERSONAL WATERCRAFT

(75) Inventors: Mathieu Duquette, Sherbrooke (CA); Pascal Toupin, Sherbrooke (CA); Maxime Valence, St-Hyacinthe (CA)

(73) Assignee: Bombardier Recreational Products Inc., Valcourt (CA)

( * ) Notice: Subject to any disclaimer, the term of this patent is extended or adjusted under 35 U.S.C. 154(b) by 219 days.

(21) Appl. No.: 12/261,311

(22) Filed: Oct. 30, 2008

(65) Prior Publication Data

US 2009/0107377 A1 Apr. 30, 2009

Related U.S. Application Data

(60) Provisional application No. 60/984,249, filed on Oct. 31, 2007.

(51) Int. Cl.
*B63B 35/73* (2006.01)

(52) U.S. Cl. ..... 114/55.5

(58) Field of Classification Search ..... 114/55.5, 114/55.57

See application file for complete search history.

(56) References Cited

U.S. PATENT DOCUMENTS

| | | | | | |
|---|---|---|---|---|---|
| 5,255,626 | A | * | 10/1993 | Hattori et al. | 114/55.53 |
| RE34,922 | E | * | 5/1995 | Hattori et al. | 114/55.55 |
| 2004/0123787 | A1 | * | 7/2004 | Nakajima et al. | 114/55.53 |
| 2008/0236471 | A1 | * | 10/2008 | Mott | 114/347 |

* cited by examiner

*Primary Examiner*—Stephen Avila
(74) *Attorney, Agent, or Firm*—Osler, Hoskin & Harcourt LLP

(57) ABSTRACT

A personal watercraft is disclosed, having a hull and sub-deck (HSD) assembly with left and right gunnels. A deck is disposed above the sub-deck. The left and right lateral edges of the deck are disposed vertically at least as low as the upper end of the left and right gunnels. The left lateral edge and the left gunnel define a left gap therebetween. The right lateral edge and the right gunnel define a right gap therebetween. A left seal member extends laterally outwardly from the left lateral edge. The left seal member extends into the left gap generally toward the left gunnel. A right seal member extends laterally outwardly from the right lateral edge. The right seal member extends into the right gap generally toward the right gunnel.

11 Claims, 16 Drawing Sheets

PERSONAL WATERCRAFT

CROSS REFERENCE

The present application claims priority to U.S. Provisional Patent Application No. 60/984,249 filed on Oct. 31, 2007, the entirety of which is incorporated herein by reference.

FIELD OF THE INVENTION

The present invention relates to personal watercraft, in particular personal watercraft having a deck, a sub-deck and a hull.

BACKGROUND OF THE INVENTION

Most of today's commercially available personal watercraft have a hull and a deck disposed directly thereon. The deck has a pedestal onto which a straddle-type seat is disposed. When such watercraft travel over waves, the forces due to impacts between the hull and the waves are transferred to the driver and passengers which can make the riding experience uncomfortable, especially over long distances. The only cushioning against these impacts is provided by the padding in the seat.

In an effort to minimize the transfer of these forces to the driver and passengers, some watercraft have a suspension element, such as a spring and damper assembly, disposed between the seat and the deck. Although this reduces the transfers of these forces to the body of the driver and passengers, this arrangement tends to solicit the legs of the driver and passengers more since the seat now moves relative to the footrests formed in the deck.

Another way to minimize the transfer of these forces to the driver and passengers consists in suspending the whole deck above the hull. The engine, fuel tank, and propulsion system are still in and/or connected to the hull and a sub-deck is disposed on the hull to protect the components in the hull from water. The hull and sub-deck together form a hull and sub-deck assembly (HSD) assembly. The deck is suspended on the HSD assembly. In this arrangement, the footrest can still be formed with the deck, and as such the legs of the drivers and passengers are less solicited than in watercraft where only the seat is suspended.

The personal watercraft may have gunnels or other portions of the HSD assembly positioned laterally outwardly of the footrests. In some personal watercraft, there is a gap between the footrests and the HSD assembly. This gap may be the result of manufacturing tolerances. The gap may instead be provided to allow relative motion between the deck and the gunnels, for example in a watercraft where the deck is supported on the hull via a suspension element.

While using a personal watercraft, the driver or a passenger may carry small items such as sunglasses, keys or other accessories. During operation of the watercraft, particularly in rough waters, it is possible for the driver or a passenger to drop one of these items. The dropped item can then fall into the gap between the deck and the HSD assembly, making it difficult to retrieve and possibly requiring removal of the deck from the watercraft to retrieve the item. If the deck is supported above the HSD assembly via a suspension system, the size of the gap may vary, and the possibility of an object falling into the gap is greater when the gap is larger.

Therefore, there is a need for a personal watercraft having a deck, a sub-deck and a hull, wherein the likelihood of objects falling into the gap between the deck and the sub-deck is reduced.

SUMMARY OF THE INVENTION

It is an object of the present invention to ameliorate at least some of the inconveniences present in the prior art.

It is also an object of the present invention to provide a personal watercraft having a deck, a sub-deck and a hull, wherein the likelihood of objects falling into the gap between the deck and the sub-deck is reduced.

In one aspect, the invention provides a personal watercraft comprising a hull. A sub-deck is disposed on the hull. The hull and sub-deck together form a hull and sub-deck (HSD) assembly. the HSD assembly has upwardly-extending left and right gunnels. Each gunnel has an upper end. An engine is disposed in the HSD assembly. A propulsion system is connected to the hull and operatively connected to the engine. A helm assembly is operatively connected to the propulsion system. A deck is disposed above the sub-deck. The deck has a pedestal. A straddle-type seat is disposed on the pedestal at least in part rearwardly of the helm assembly. Left and right lateral edges are disposed laterally outwardly of the pedestal. The left and right lateral edges are disposed vertically at least as low as the upper end of the left and right gunnels. The left lateral edge and the left gunnel define a left gap therebetween. The right lateral edge and the right gunnel define a right gap therebetween. A left seal member extends laterally outwardly from the left lateral edge. The left seal member extends into the left gap generally toward the left gunnel. A right seal member extends laterally outwardly from the right lateral edge. The right seal member extends into the right gap generally toward the right gunnel.

In a further aspect, the deck also has a left footrest disposed laterally outwardly of the pedestal and laterally inwardly of the left lateral edge. The deck also has a right footrest disposed laterally outwardly of the pedestal and laterally inwardly of the right lateral edge. The left and right footrests are vertically lower than the upper ends of the left and right gunnels.

In a further aspect, the left and right footrests extend longitudinally at least the length of the seat.

In a further aspect, the left seal member extends substantially along an entire length of the left footrest. The right seal member extends substantially along an entire length of the right footrest.

In a further aspect, the personal watercraft further comprises a suspension element. A first portion of the suspension element is connected to the deck. A second portion of the suspension element is connected to the HSD assembly. The suspension element permits relative movement between the deck and the HSD assembly. The HSD assembly is movable relative to the deck between a first position in which the HSD assembly is disposed a first distance below the deck and a second position in which the HSD assembly is disposed a second distance below the deck. The second distance is smaller than the first distance. The left and right lateral edges are disposed vertically at least as low as the upper end of the left and right gunnels when the HSD assembly is in the first and second positions.

In a further aspect, the left gap has a first width when the HSD assembly is in the first position. The left gap has a second width when the HSD assembly is in the second position. The second width is smaller than the first width. The right gap has a third width when the HSD assembly is in the first position. The right gap has a fourth width when the HSD assembly is in the second position. The fourth width is smaller than the third width.

In a further aspect, when the HSD assembly is in the second position an outer portion of the left seal member is in contact with the left gunnel. An outer portion of the right seal member is in contact with the right gunnel.

In a further aspect, when the HSD assembly is in the first position an outer portion of the left seal member is in contact with the left gunnel. An outer portion of the right seal member is in contact with the right gunnel.

In a further aspect, the outer portion of the left seal member follows an inner side of the left gunnel as the HSD assembly moves between the first position and the second position. The outer portion of the right seal member follows an inner side of the right gunnel as the HSD assembly moves between the first position and the second position.

In a further aspect, the left and right seal members contain an elastomeric material.

In a further aspect, the left and right seal members contain thermoplastic rubber.

For purposes of this application, terms related to spatial orientation such as forwardly, rearwardly, left, and right, are as they would normally be understood by a driver of the vehicle sitting thereon in a normal riding position. Also, the term "laterally inwardly" means toward the longitudinal centerline of the vehicle and the term "laterally outwardly" means away from the longitudinal centerline of the vehicle.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

Figure 5:
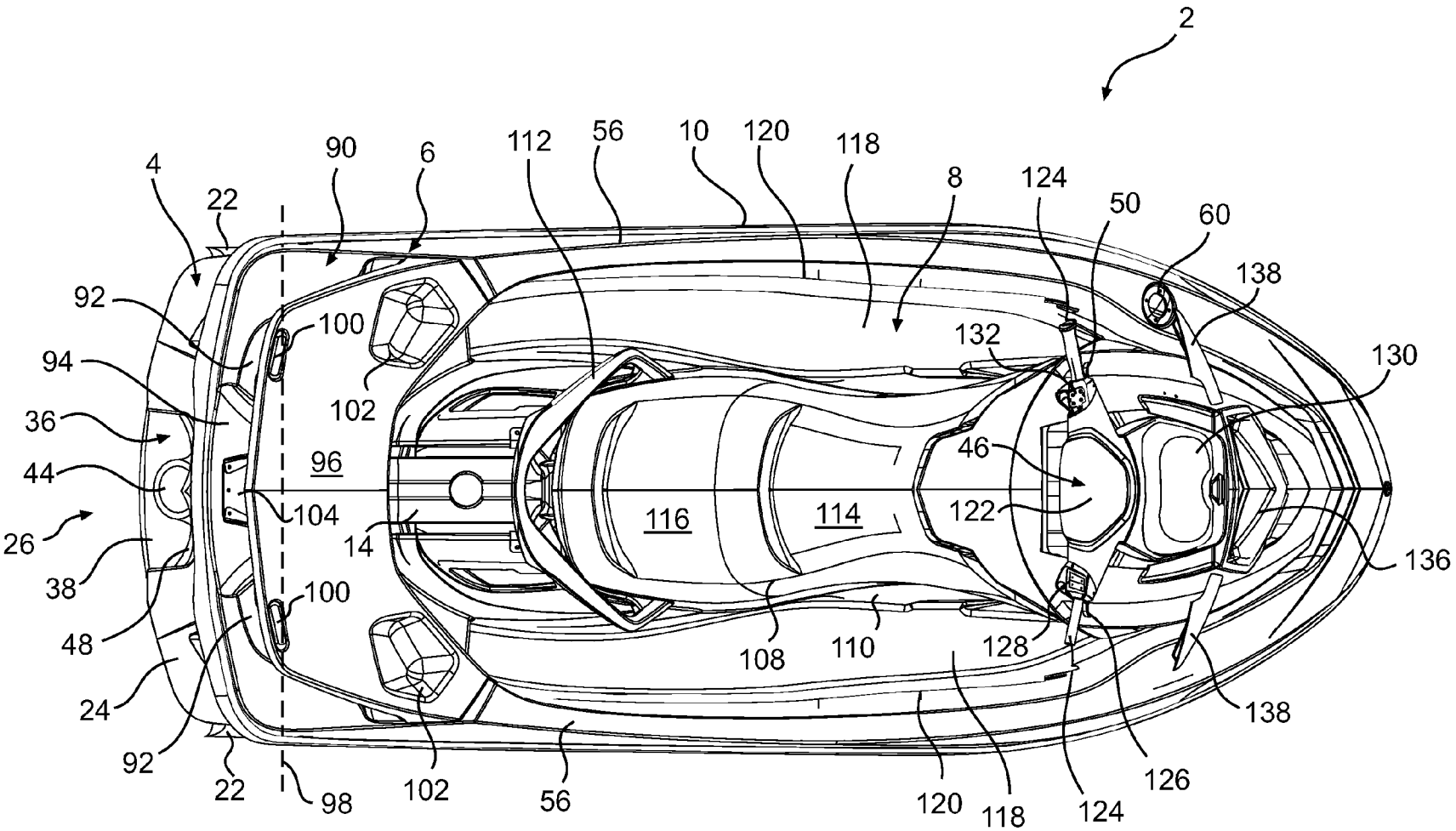
FIG. 5 is a perspective view, taken from a top, rear side, of the watercraft of FIG. 1.
Figure 6:
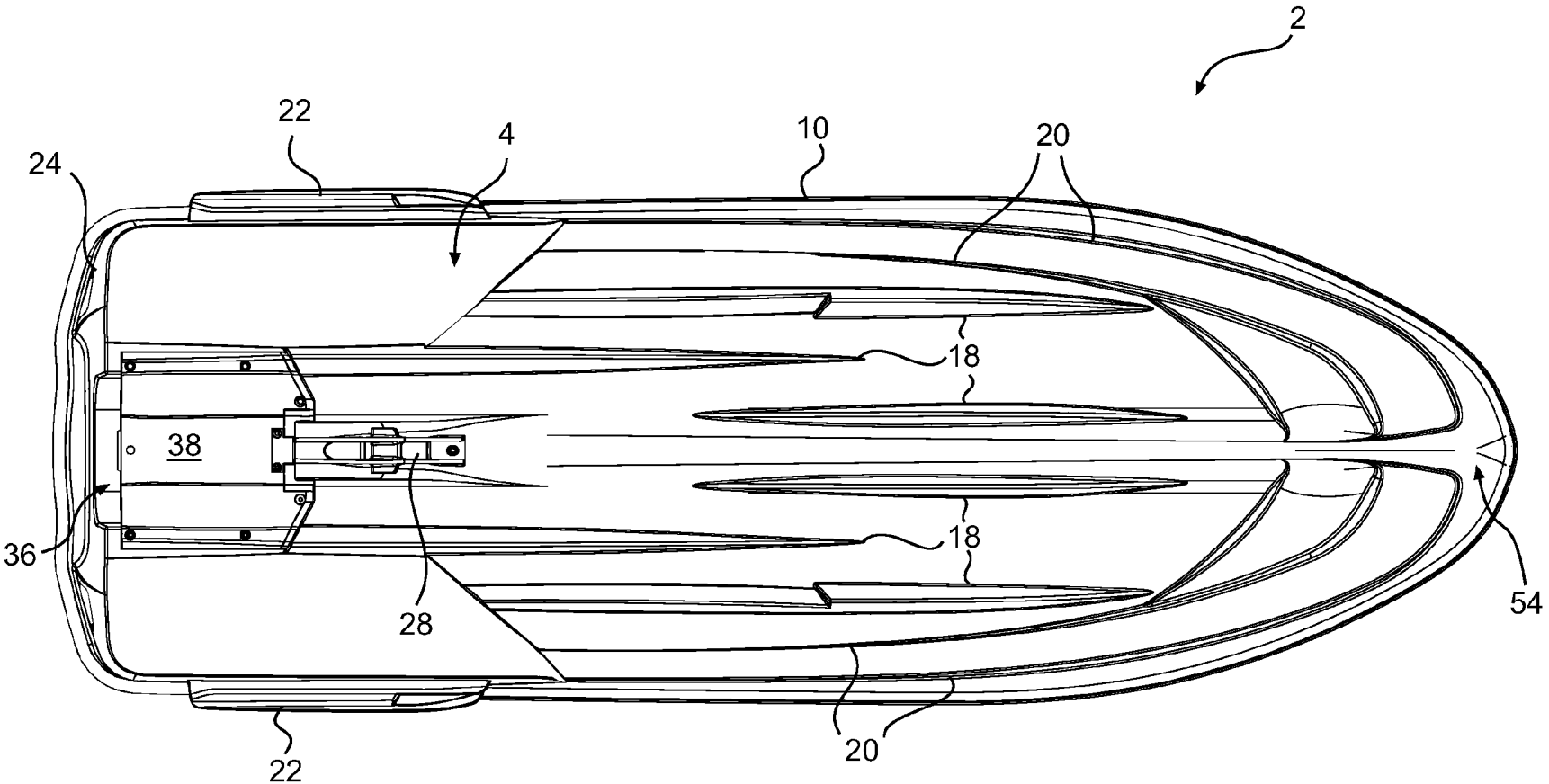
FIG. 6 is a bottom plan view of the watercraft of FIG. 1.
Figure 7:
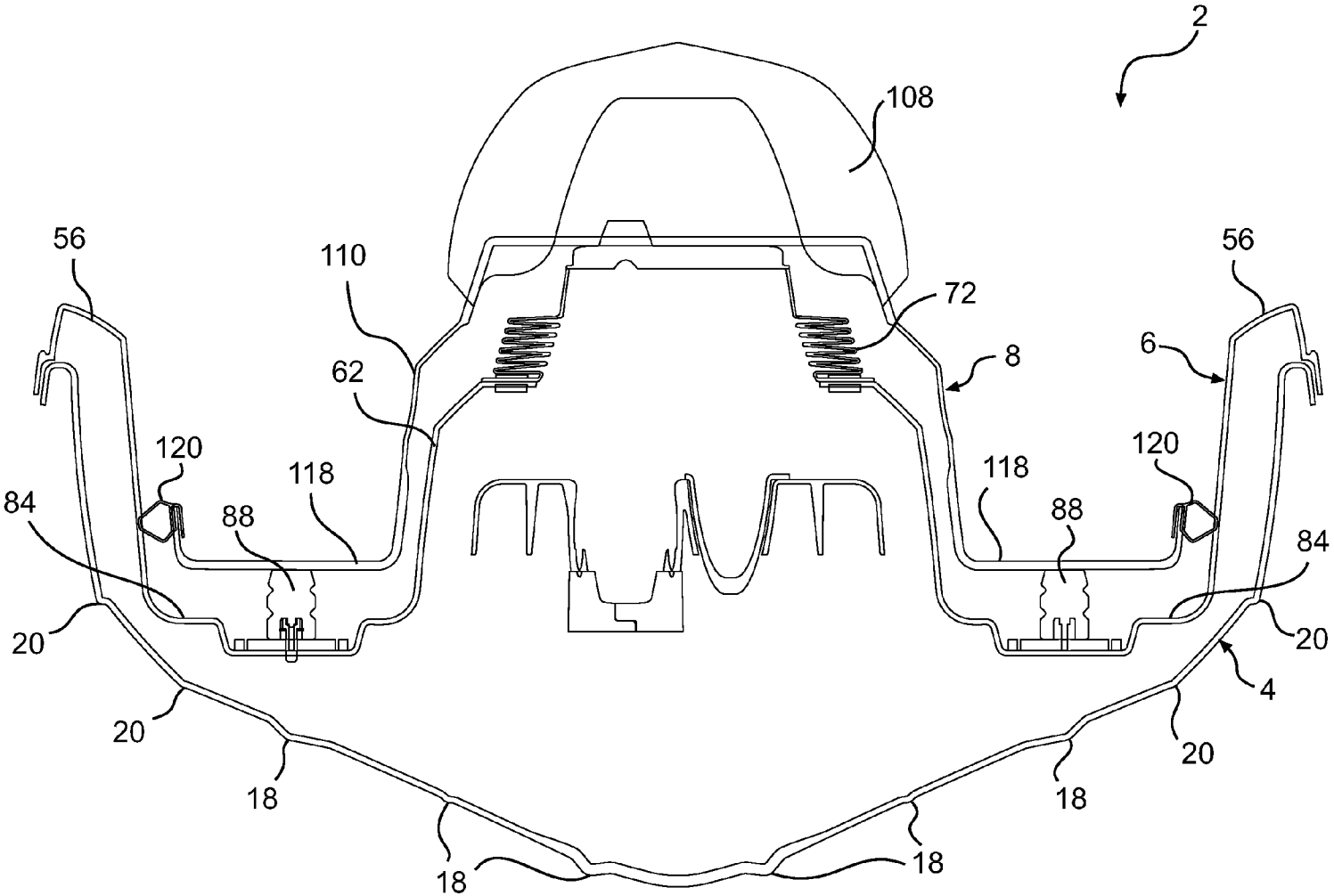
FIG. 7 is a schematic view of a transverse cross-section of the watercraft of FIG. 1.
Figure 8:
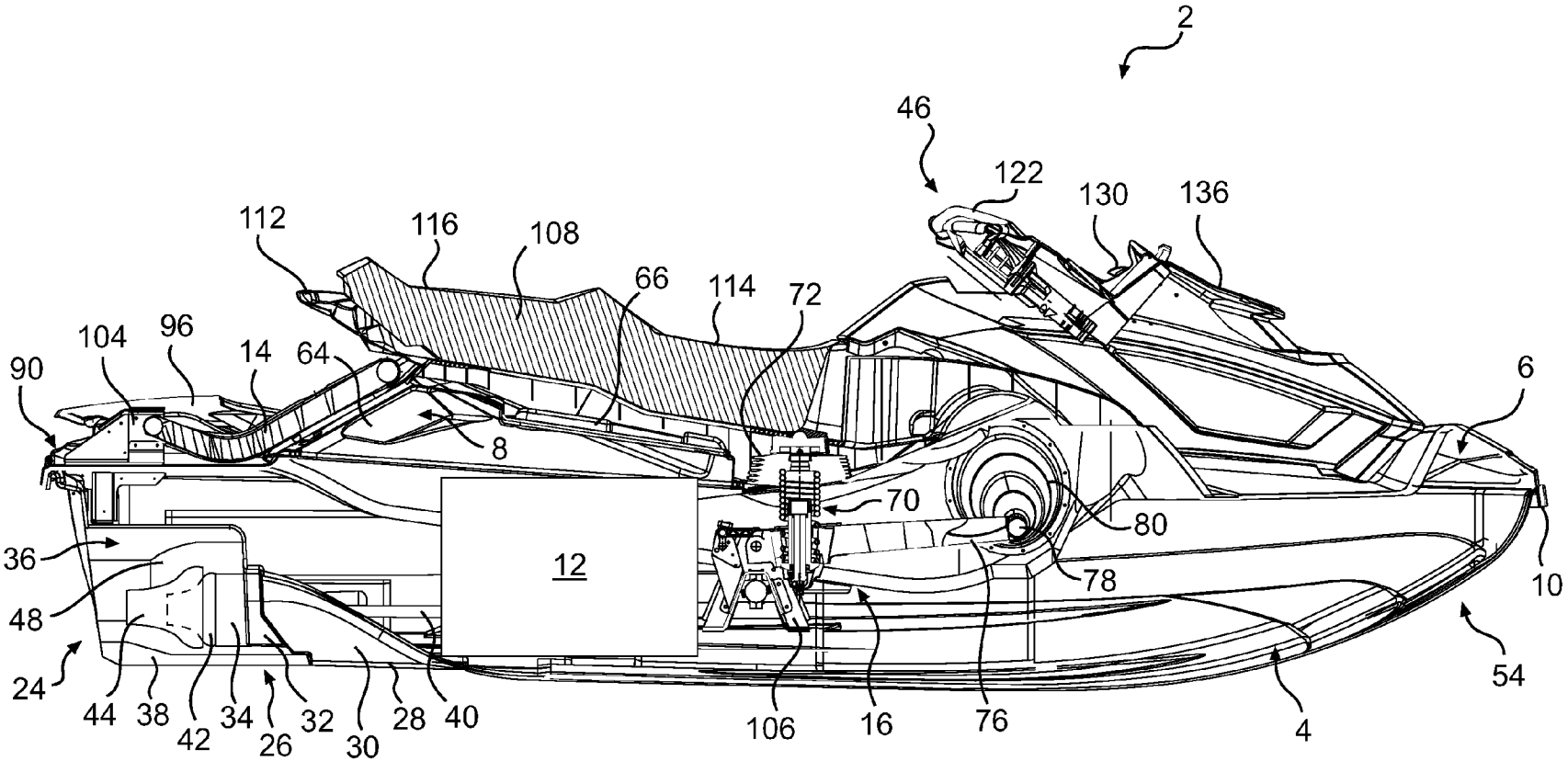
FIG. 8 is a partial longitudinal cross-section of the watercraft of FIG. 1 showing some of the internal components thereof.
Figure 9:
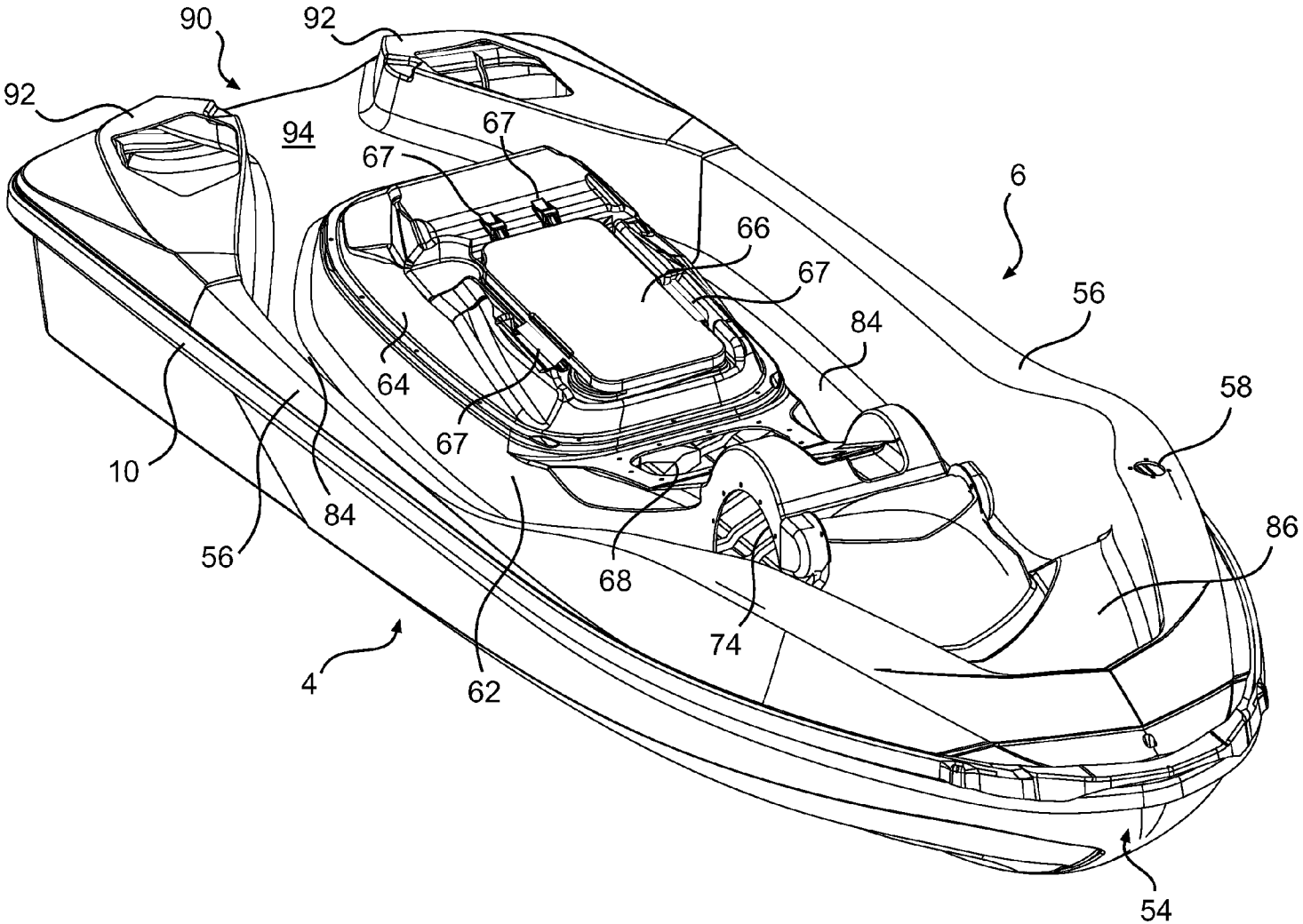
FIG. 9 is a perspective view, taken from a front, right side, of a hull and sub-deck assembly of the watercraft of FIG. 1, with the engine cowling thereon.
Figure 10:
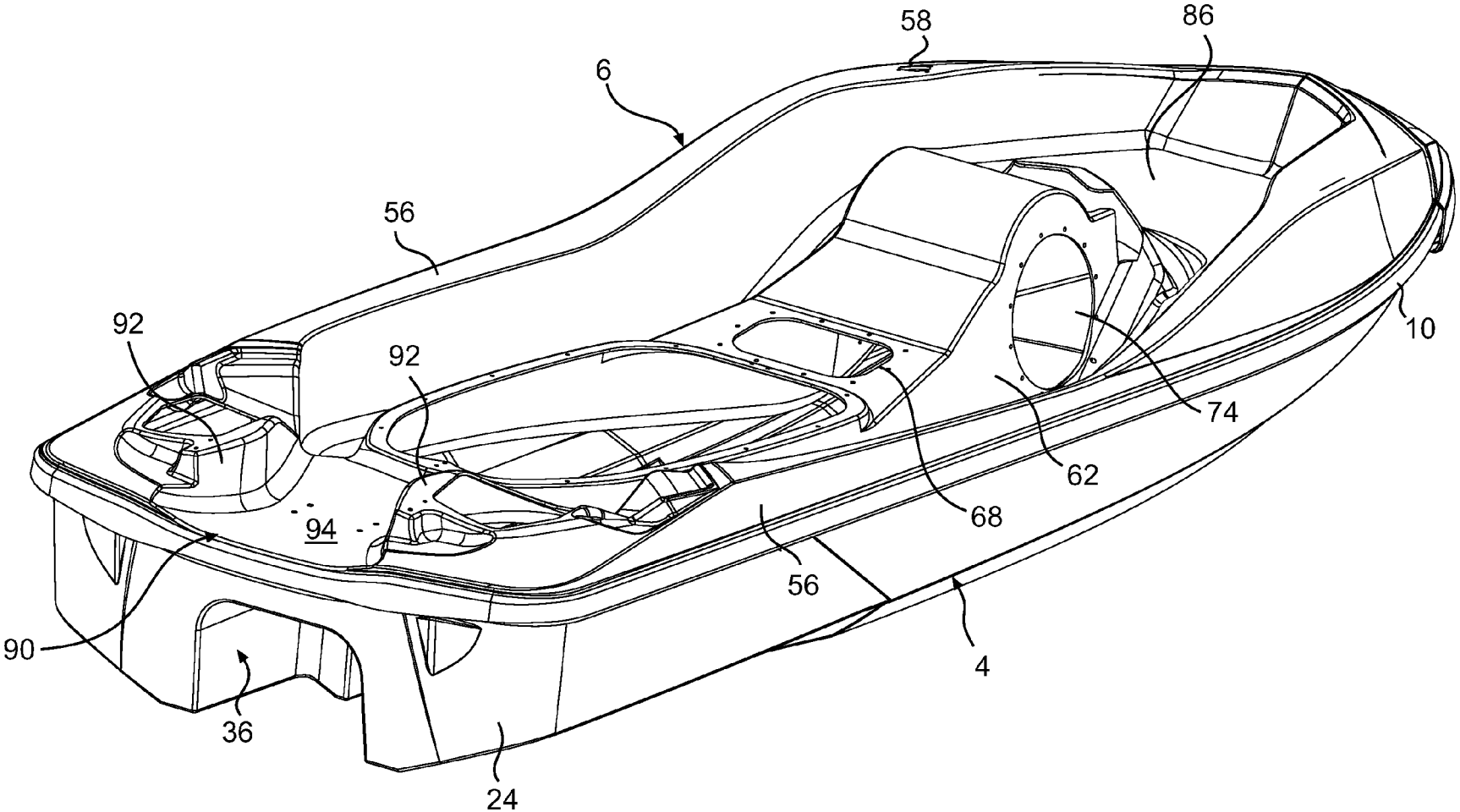
FIG. 10 is a perspective view, taken from a rear, right side, of the hull and sub-deck assembly of FIG. 9, with the engine cowling removed.
Figure 11:
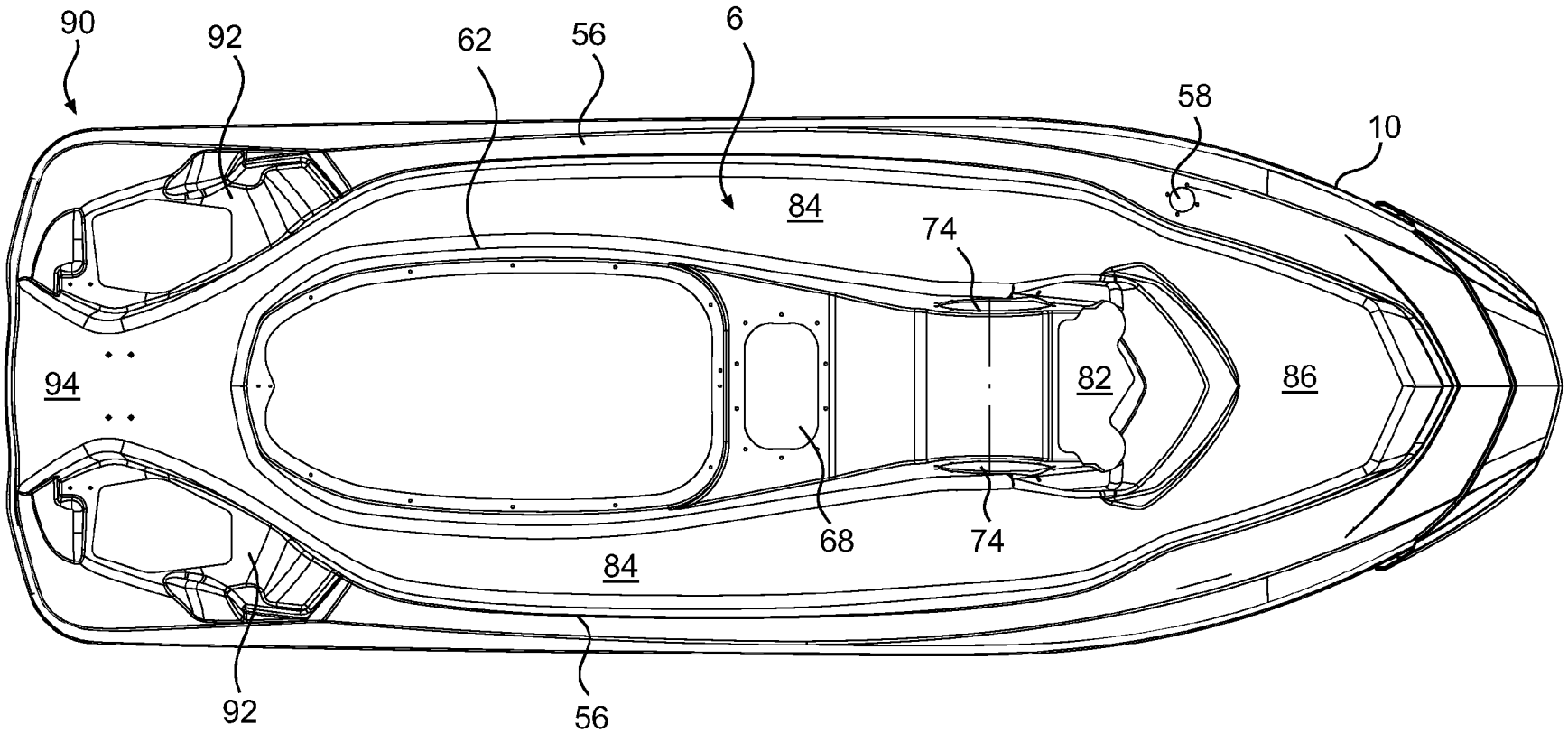
FIG. 11 is a top plan view of the hull and sub-deck assembly of FIG. 9, with the engine cowling removed.

Turning to FIGS. 1 to 12, a personal watercraft 2 will be described. The watercraft 2 is made of three main parts. These parts are the hull 4, the sub-deck 6, and the deck 8. As best seen in FIGS. 9 to 11, the hull 4 and sub-deck 6 are joined together, preferably by an adhesive, to form a hull and sub-deck (HSD) assembly. Rivets or other fasteners may also join the hull 4 and sub-deck 6. A bumper 10 generally covers the joint helping to prevent damage to the outer edge of the watercraft 2 when the watercraft 2 is docked. The volume created between the hull 4 and the sub-deck 6 is known as the engine compartment. The engine compartment accommodates the engine 12 (schematically shown in FIG. 8) as well as the muffler, exhaust pipe, gas tank, electrical system (including for example a battery and an electronic control unit), air box, storage bins (not shown) and other elements required by or desired for the watercraft 2. The deck 8 (FIG. 3) is designed to accommodate a driver and one or more passengers. As best seen in FIGS. 7 and 8, the deck 8 is suspended on the HSD assembly by a rear suspension member in the form of a rear suspension arm 14 and a front suspension assembly 16 described in greater detail below. It is contemplated that the deck 8 could be fixedly connected to the HSD assembly.

Figure 1:
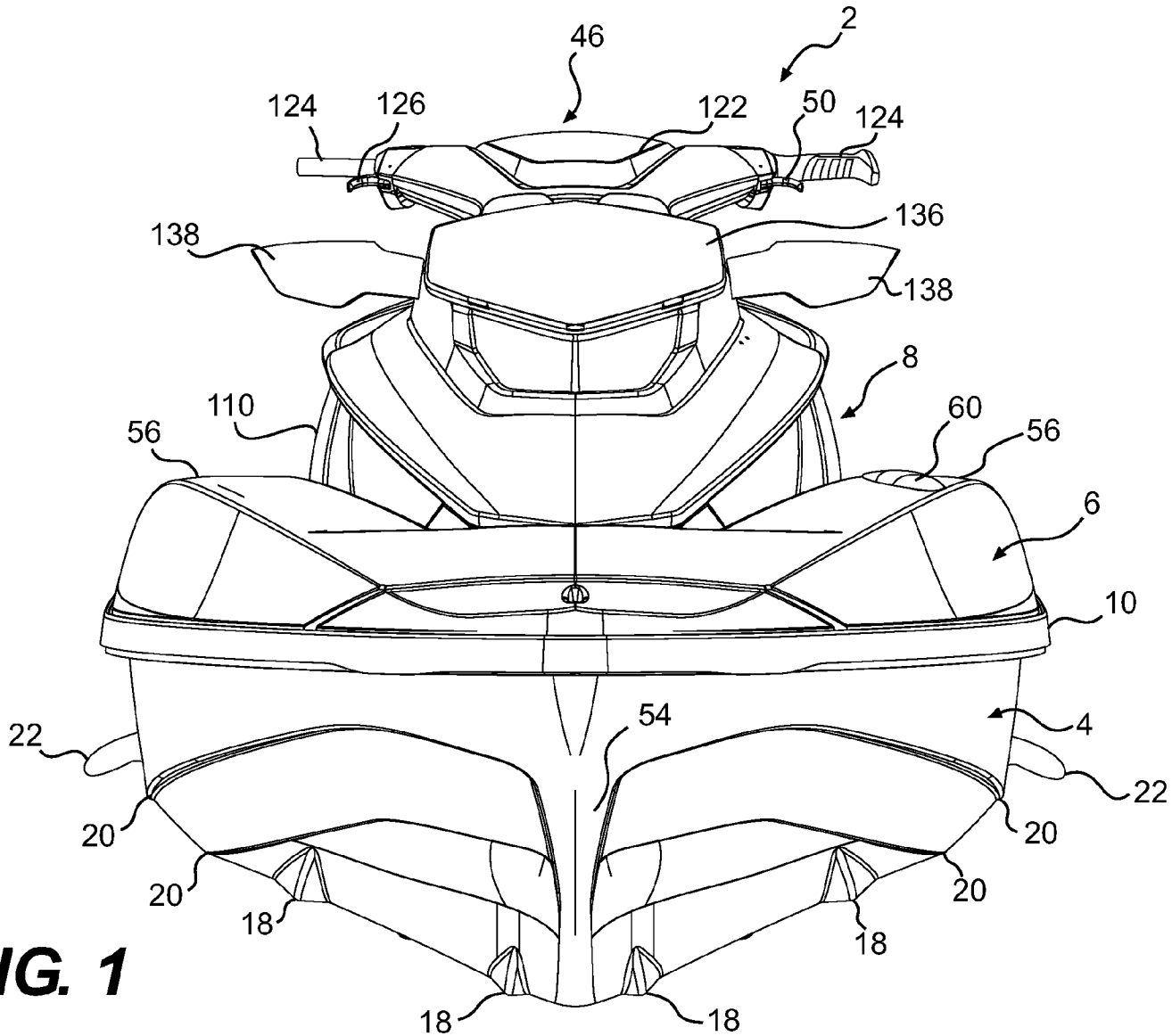
FIG. 1 is a front elevation view of a personal watercraft according to the present invention.

As best seen in FIGS. 1 and 6, the hull 4 is provided with a combination of strakes 18 and chines 20. A strake 18 is a protruding portion of the hull 4. A chine 20 is the vertex formed where two surfaces of the hull 4 meet. It is this combination of strakes 18 and chines 20 that will give, at least in part, the watercraft 2 its riding and handling characteristics.

Sponsons 22 are located on either side of the hull 4 near the transom 24. The sponsons 22 have an arcuate undersurface, which give the watercraft 2 both lift while in motion and improved turning characteristics.

Figure 2:
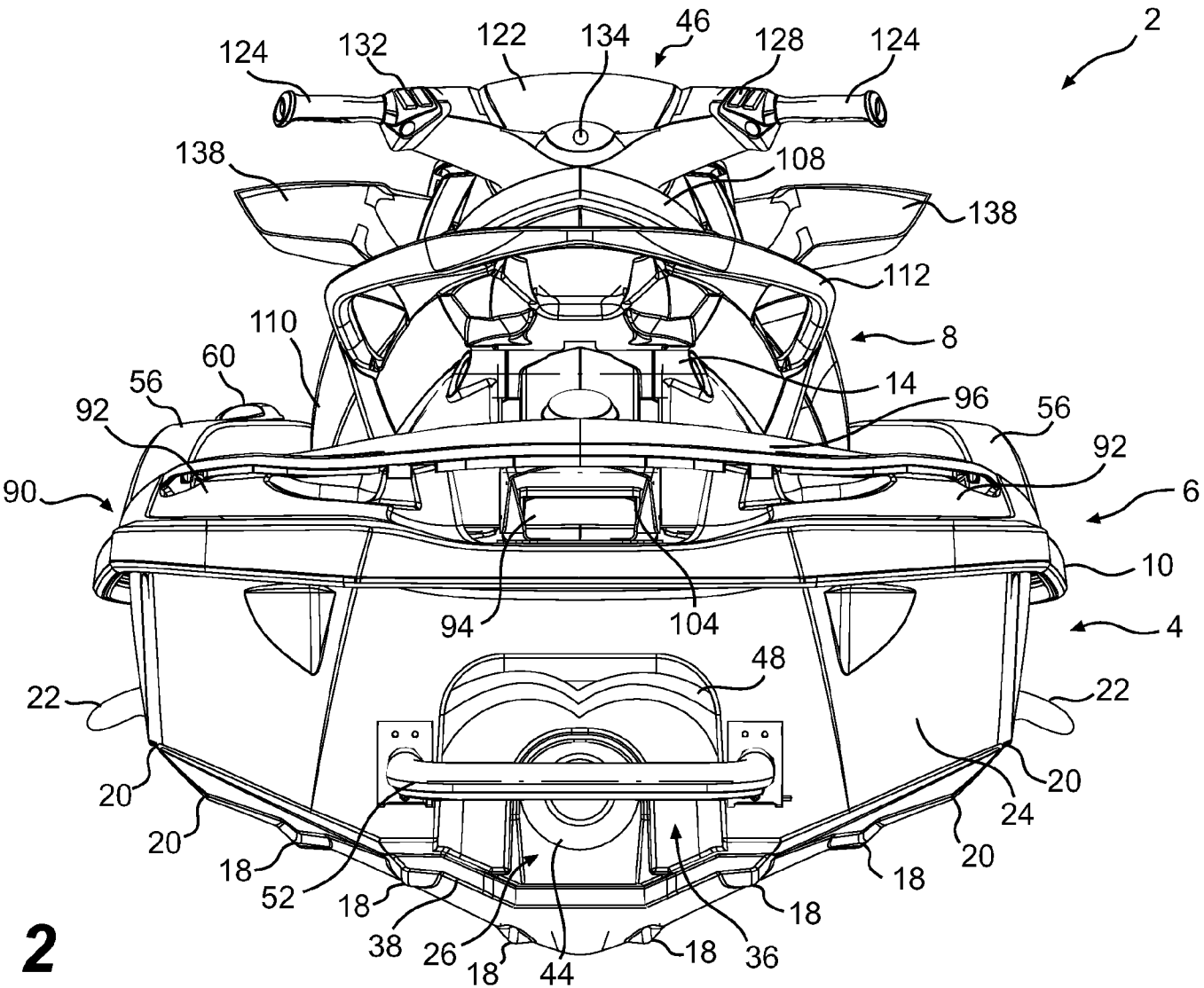
FIG. 2 is a rear elevation view of the watercraft of FIG. 1.
Figure 3:
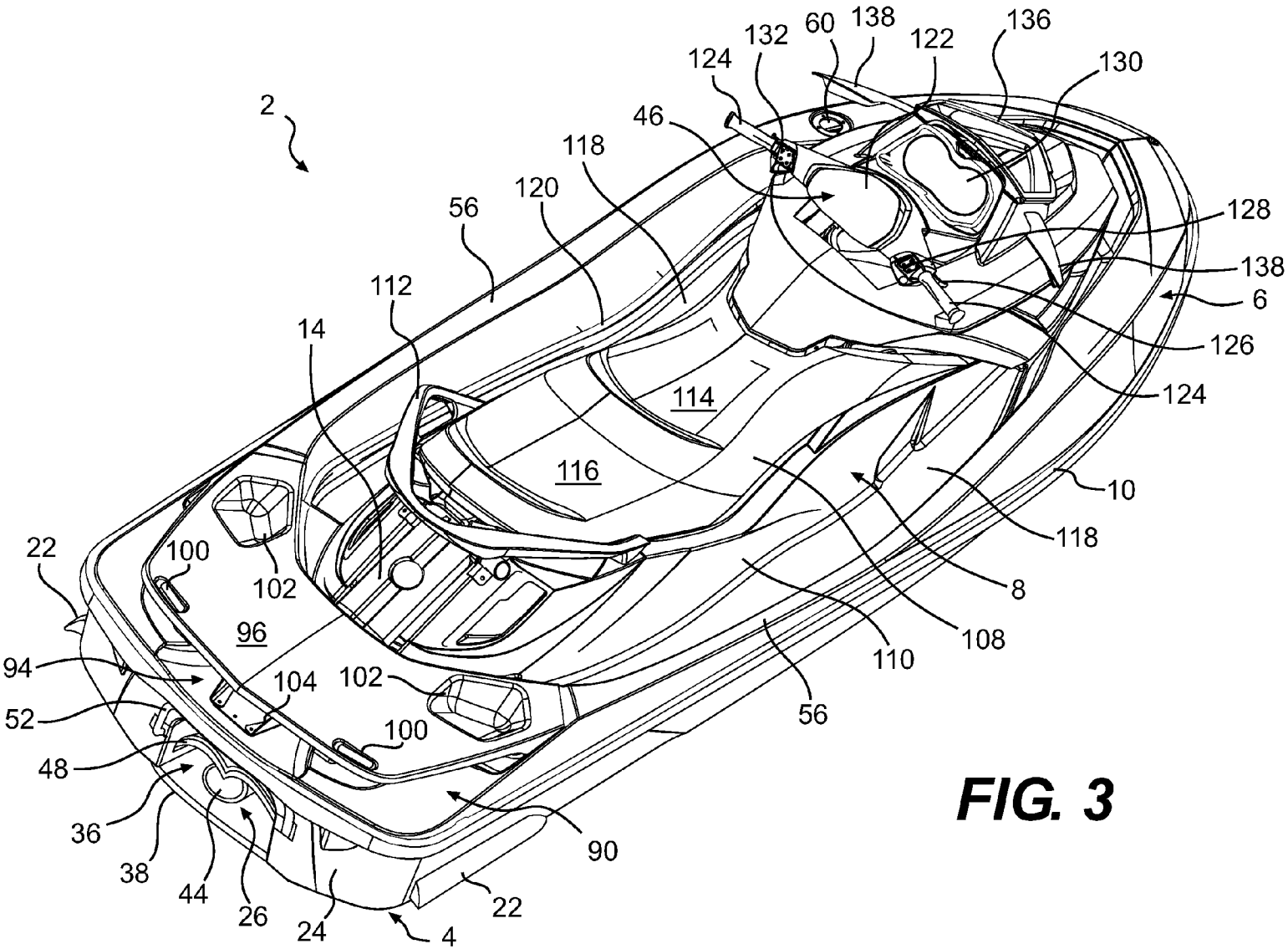
FIG. 3 is a perspective view, taken from a rear, right side, of the watercraft of FIG. 1.
Figure 4:
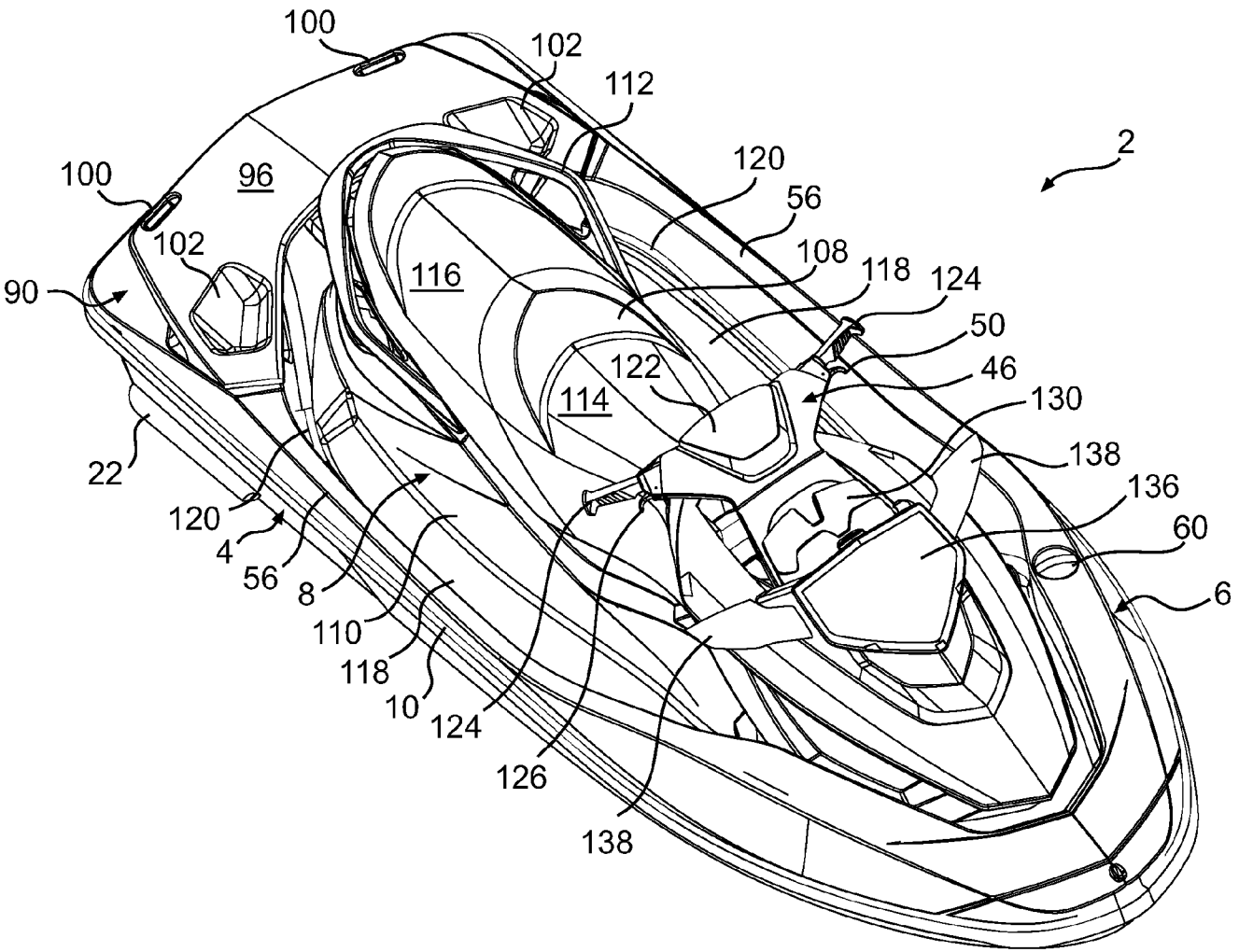
FIG. 4 is a perspective view, taken from a front, right side, of the watercraft of FIG. 1.

As best seen in FIGS. 2 and 8, a jet propulsion system 26 is connected to the hull 4. The jet propulsion system 26 pressurizes water to create thrust. The water is first scooped from under the hull 4 through the inlet grate 28 (FIG. 6). The inlet grate 28 prevents large rocks, weeds, and other debris from entering the jet propulsion system 26 since they may otherwise damage it or negatively affect its performance. Water then flows through a water intake ramp 30. The top portion of the water intake ramp 30 is formed by hull 4 and a ride shoe 32 forms its bottom portion. Alternatively, the intake ramp 30 may be a single piece to which a jet pump unit 34 attaches. In such cases, the intake ramp 30 and the jet pump unit 34 are attached as a unit in a recess in the bottom of hull 4. From the intake ramp 30, water then enters the jet pump unit 34. The jet pump unit 34 is located in what is known as the tunnel 36. The tunnel 36 is opened towards the rear, is defined at the front, sides, and top by the hull 4, and at the bottom by a ride plate 38. The ride plate 38 is the surface on which the watercraft 2 rides or planes. The jet pump unit 34 includes an impeller and a stator (not shown) enclosed in a cylindrical housing. The impeller is coupled to the engine 12 by one or more shafts 40, such as a driveshaft and an impeller shaft. The rotation of the impeller pressurizes the water, which then moves over the stator that is made of a plurality of fixed stator blades (not shown). The role of the stator blades is to decrease the rotational motion of the water so that almost all the energy given to the water is used for thrust, as opposed to swirling the water. Once the water leaves the jet pump unit 34, it goes through the venturi 42. Since the venturi's exit diameter is smaller than its entrance diameter, the water is accelerated further, thereby providing more thrust. A steering nozzle 44 is pivotally attached to the venturi 42 about a vertical pivot axis. The steering nozzle 44 is operatively connected to a helm assembly 46 disposed on the deck 8 via a push-pull cable (not shown) such that when the helm assembly 46 is turned, the steering nozzle 44 pivots, redirecting the water coming from the venturi 42, so as to steer the watercraft 2 in the desired direction. It is contemplated that the steering nozzle 44 may be gimbaled to allow it to move about a second horizontal pivot axis (not shown). The up and down movement of the steering nozzle 44 provided by this additional pivot axis is known as trim, and controls the pitch of the watercraft 2. It is contemplated that other types of propulsion systems, such as a propeller, could be used.

A reverse gate 48 is pivotally attached to the sidewalls of the tunnel 36. It is contemplated that the reverse gate 48 could alternatively be pivotally attached to the venturi 42 or the steering nozzle 44. The reverse gate 48 is operatively connected to an electric motor (not shown) and the driver of the watercraft can control the position of the reverse gate 48 by pulling lever 50 (FIG. 1) located on the left side of the helm assembly 46 which is in electrical communication with the electric motor. It is contemplated that the reverse gate 48 could alternatively be mechanically connected to a reverse handle to be pulled by the driver. To make the watercraft 2 move in a reverse direction, the reverse gate 48 is pivoted in front of the steering nozzle 44 and redirects the water leaving the jet propulsion system 26 towards the front of the watercraft 2, thereby thrusting the watercraft 2 rearwardly.

A retractable ladder 52, best seen in FIG. 2 in its lowered position, is affixed to the transom to facilitate boarding 24 the watercraft 2 from the water.

Hooks (not shown) are located on the bow and transom 24 of the watercraft 2. These hooks are used to attach the watercraft 2 to a dock when the watercraft 2 is not in use or to a trailer when the watercraft 2 is being transported outside the water.

When the watercraft 2 is in movement, its speed is measured by a speed sensor (not shown) attached to the transom 24 of the watercraft 2. The speed sensor has a paddle wheel which is turned by the flow of water, therefore the faster the watercraft 2 goes, the faster the paddle wheel turns. An electronic control unit (not shown) connected to the speed sensor converts the rotational speed of the paddle wheel to the speed of the watercraft 2 in kilometers or miles per hour, depending on the driver's preference. The speed sensor may also be placed in the ride plate 38 or any other suitable position. Other types of speed sensors, such as pitot tubes, could also be used. It is also contemplated that the speed of the watercraft 2 could be determined from input from a GPS mounted to the watercraft 2.

Turning now to FIGS. 7 to 11, features of the sub-deck 6 will be described. The sub-deck 6 has a pair of generally upwardly extending walls located on either side thereof known as gunwales or gunnels 56. The gunnels 56 help to prevent the entry of water in the watercraft 2 and also provide buoyancy when turning the watercraft 2, since the watercraft 2 rolls slightly when turning. A refueling opening 58 is provided on the front left gunnel 56. A hose (not shown) extends from the refueling opening 58 to the fuel tank (not shown) disposed near the bow 54 in the volume formed between the hull 4 and the sub-deck 6. This arrangement allows for refilling of the fuel tank. A fuel cap 60 (FIG. 1) is used to sealingly close the refueling opening 58, thereby preventing water from entering the fuel tank when the watercraft 2 is in use.

A pedestal 62 is centrally positioned on the sub-deck 6. The pedestal 62 accommodates the internal components of the watercraft 2, such as the engine 12, and shields these components from water. A portion of the rear of the pedestal 62, known as the engine cowling 64 (FIG. 9) can be removed to permit access to the engine 12. The engine cowling 64 is fastened to the remainder of the sub-deck 6 and a seal is disposed between the engine cowling 64 and the remainder of the sub-deck 6 to prevent water intrusion. The top portion of the engine cowling 64 is closed by a removable air intake unit 66. The air intake unit 66 is attached to the pedestal 62 by clips 67. The air intake unit 66 incorporates a system of arcuate passages and baffles which permit air to enter the volume between the hull 4 and the sub-deck 6, and thus be supplied to the engine 12, while reducing the likelihood of water entering that volume. Air enters around the sides of the air intake unit 66, goes through the passages and baffles therein, and then goes down a tube connected to the bottom of the air intake unit 66 and opening near the bottom of the hull 4. Removal of the air intake unit 66 permits access to elements located near the top of the engine 12 which need to be accessed more regularly, such as spark plugs (not shown) or the oil dipstick (not shown). A tow hook (not shown) is provided on the rear suspension arm to provide an attachment point for towing a water-skier or an inflatable device for example.

An opening 68 is provided in the upper portion of the pedestal 62 forwardly of the engine cowling 64 to permit suspension elements 70 (FIG. 8) of the front suspension assembly 16 to pass therethrough. The suspension elements 70 absorb the loads as the HSD assembly moves relative to the deck 8 and dampen the motion. The suspension elements 70 can include, but are not limited to, one or more springs and a hydraulic damper. It is contemplated that the suspension assembly 16 could include a single suspension element. A bellows 72 (FIG. 8) is sealed around the opening 68 at a lower end thereof and is connected to the deck 8 at an upper end thereof to prevent water from entering the opening 68 while permitting relative movement between the sub-deck 6 and the deck 8. Two openings 74 are provided on the sides of the pedestal 62 forwardly of the opening 68. As seen in FIGS. 8 and 9, these openings 74 allow a front suspension member of the front suspension assembly 16 to be pivotally connected to the deck 8. More specifically, the front suspension member includes a front suspension arm 76 and a shaft 78, and the upper end of the front suspension arm 76 is connected to the shaft 78 which extends through the openings 74 to pivotally connect to the deck 8. It is contemplated that the front suspension member could be made of a single part or that it could be made of more parts. Bellows 80 are connected to the sub-deck 6 around the openings 74 at one end thereof and are sealingly connected around brackets (not shown) that are attached to the shaft 78 at the other end thereof. The bellows 80 thus seal and prevent water from entering the openings 74 while permitting relative movement between the sub-deck 6 and the deck 8. Another opening 82 (best seen in FIG. 11) is located in the sub-deck 6 forwardly of the openings 74. Opening 82 allows the passage of two air intake tubes (not shown). Each intake tube has one end opened to a side of the pedestal 62 (one on each side), extends laterally to the other side of the pedestal 62, then moves down near the bottom of the hull 4, thus reducing the likelihood of water entering therethrough in case the watercraft 2 were to flip over. The deck 8 disposed on top of the sub-deck 6 also helps to prevent water from entering the various openings 68, 74, the air intake unit 66, and the air intake tubes by shielding them from direct exposure to water during normal operation. Should any water enter the volume between the hull 4 and the sub-deck 6, it will pool at the bottom of the hull 4 where it will be evacuated by a bilge system (not shown) as is know in the art.

As best seen in FIGS. 7 and 11, side channels 84 are formed between the gunnels 56 and the pedestal 62. The side channels 84 communicate with a recess 86 forward of the pedestal 62. The side channels 84 and the recess 86 receive the lower portions of the deck 8 and permit relative movement between the deck 8 and the sub-deck 6. Rubber mounts 88 (FIG. 7) are connected to the bottom of the side channels 84 to limit the relative movement of the sub-deck 6 towards the deck 8, and thus absorbing some of the impact should they come into contact.

A rear portion 90 of the sub-deck 6 is disposed higher than a bottom of the side channels 84. The rear portion 90 is high enough that, when the watercraft 2 is at rest and under normal loading conditions (i.e. no excess passengers or cargo), the rear portion 90 is disposed above the waterline thus preventing water from infiltrating into the side channels 84 from the back of the watercraft 2. The rear portion 90 has a raised portion on each side thereof forming storage compartments 92. The volume formed by the storage compartments 92 increase the buoyancy of the watercraft 2 and therefore, the lateral stability thereof. A rear channel 94 is formed between the two storage compartments 92. The rear channel 94 is disposed on a lateral center of the sub-deck 6 and its width is selected such that when the watercraft 2 turns (and therefore tilts) water will not enter the side channels 84 from the rear channel 94. When the watercraft 2 moves forward, the bow 54 raises, thus raising the side channels 84. This permits any water accumulated in the side channels 84 to drain through the rear channel 94.

Figure 12:
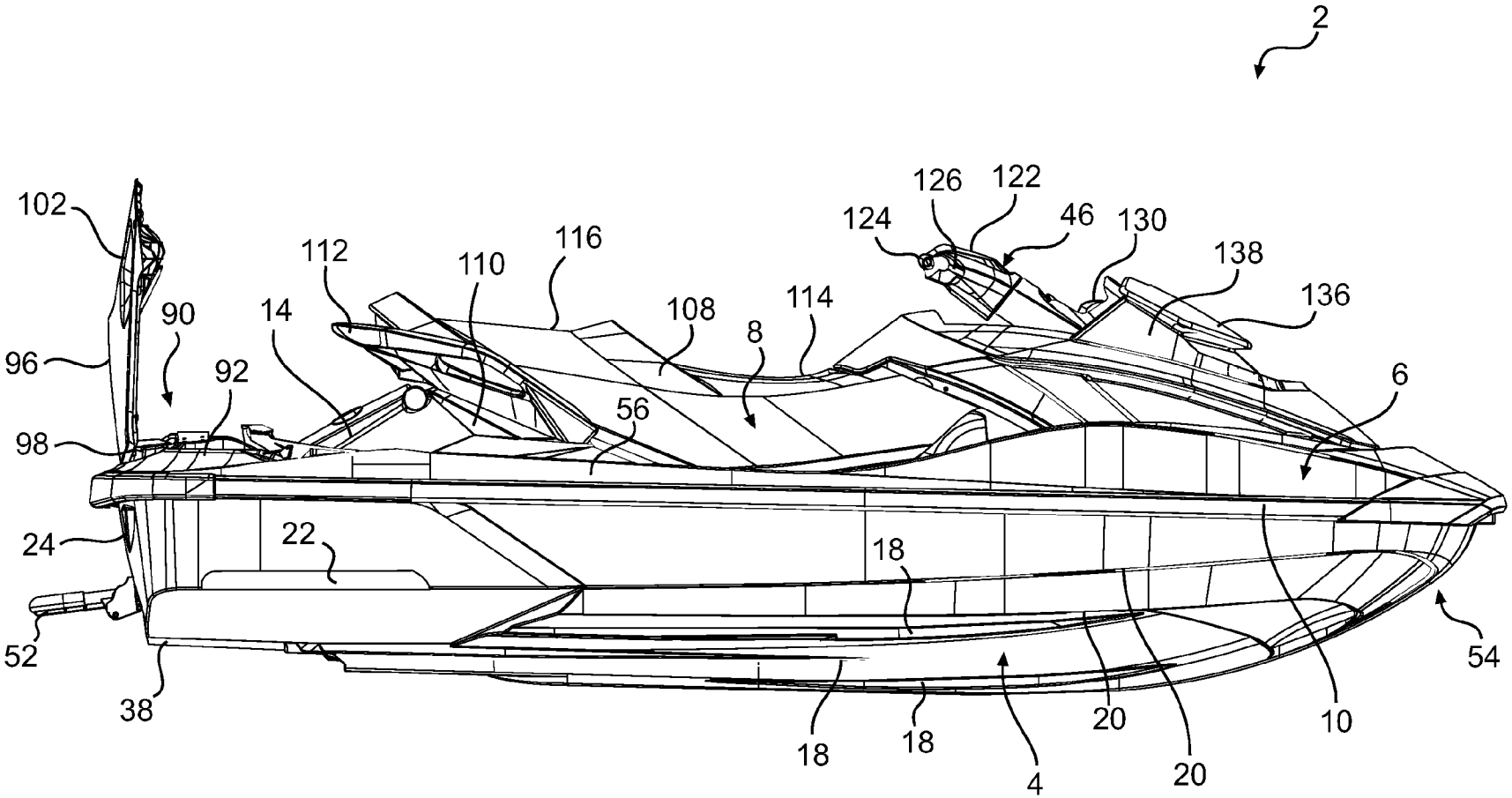
FIG. 12 is a side elevation view of the watercraft of FIG. 1 with a rear platform thereof in a raised position.

A rear platform 96 is pivotally connected on the rear portion 90 of the sub-deck 6. The platform 96 preferably pivots about an axis 98 (FIGS. 5 and 12) located near the transom 24 and extending laterally across the sub-deck 6. It is contemplated that the platform 96 could alternatively pivot about an axis located near the front of thereof and extending laterally across the sub-deck 6. It is also contemplated that the platform 96 could alternatively pivot about an axis extending generally parallel to a longitudinal axis of the watercraft 2 and disposed near a lateral side of the platform 96. When the rear platform 96 is in a raised position, as shown in FIG. 12, it permits access to the storage compartments 92. When the rear platform 96 is in a lowered, horizontal position, as shown in FIGS. 2 to 5, the rear platform 96 closes and seals the storage compartments 92, thus eliminating the need of separate lids to accomplish this function. In the lowered position, the rear platform 96 provides a surface on which the driver or passengers can stand when the watercraft 2 is at rest. Two recesses in the rear platform 96 form hand grips 100 which a person can grab to assist themselves when reboarding the watercraft 2 from the water. Two more recesses in the rear platform 96 form heel rests 102 which a passenger sitting on the watercraft 2 facing rearwardly, for spotting a water-skier being towed by the watercraft 2 for example, can use to place their heels to provide them with additional stability. Carpeting made of a rubber-type material preferably covers the rear platform 96 to provide additional comfort and feet traction on the rear platform 96.

Turning back to FIGS. 1 to 8, the deck 8 of the watercraft 2 will be described. As previously mentioned, the deck 8 is suspended on the HSD assembly. As seen in FIG. 8, the rear portion of the deck 8 is pivotally connected to the upper end of the rear suspension arm 14. The rear suspension arm 14 extends downwardly and rearwardly from its connection to the rear portion of the deck 8 and the lower end of the rear suspension arm 14 pivotally connects to a bracket 104 on the rear portion 90 of the sub-deck 6. It is contemplated that the bracket 104 could be disposed inside the volume between the hull 4 and the sub-deck 6, with the addition of an opening in the rear portion 90 of the sub-deck 6 and of a bellows similar to bellows 80 extending between the opening and the rear suspension arm 14 to prevent the intrusion of water in the watercraft 2. The front portion of the deck 8 is connected to the front suspension assembly 16. The front portion of the deck 8 is connected, via shaft 78, to the upper end of the front suspension arm 76. The front suspension arm 76 extends downwardly and rearwardly from its connection to the front portion of the deck 8 and the lower end of the front suspension arm 76 pivotally connects to a bracket 106 on the bottom of the hull 4. Suspension elements 70 are connected at their lower ends to the front suspension arm 76 forwardly of the bracket 106 and extend upwardly to connect to the under side of the deck 8 at their upper ends. The force absorption characteristics of the suspension elements 70 can be adjusted by the driver of the watercraft 2 to take into account the load on the deck 8 (i.e. the presence or absence of passengers and/or cargo) and/or to change the riding characteristics of the watercraft 2. The geometry of the rear and front suspension arms 14, 76 is such that as the watercraft 2 moves on the water, the HSD assembly will move rearwardly and upwardly relative to the deck 8 as it encounters waves, thus absorbing the impact thereby providing a more comfortable ride for the driver and passengers, if applicable, since the deck 8 will be more stable.

As seen in FIGS. 1 to 5, the deck has a centrally positioned straddle-type seat 108 placed on top of a pedestal 110 to accommodate the driver and passengers in a straddling position. A grab handle 112 is provided between the pedestal 110 and the straddle-type seat 108 at the rear of the straddle-type seat 108 to provide a handle onto which a passenger may hold on. The straddle-type seat 108 has a first seat portion 114 to accommodate the driver and second seat portion 116 to accommodate one or two passengers. The seat 108 is pivotally connected to the pedestal 110 at the front thereof by a system of linkages and is connected at the rear thereof by a latch assembly (not shown). The seat 108 selectively covers an opening (not shown), defined by a top portion of the pedestal 110, which provides access to the air intake unit 66, which once removed, provides access to the upper portion of the engine 12.

Located on either side of the pedestal 110, between the pedestal 110 and the gunnels 56 of the sub-deck 6, are a pair of generally horizontal footrests 118 designed to accommodate the driver's and passengers' feet. By having the footrests 118 form part of the deck 8, the legs of the driver and passengers are not moving with the HSD assembly, and therefore the driver's and passengers' legs are not solicited to absorb part of the impact between the watercraft 2 and the waves. As best seen in FIGS. 5 and 7, a seal 120 is disposed between each footrest 118 and its corresponding gunnel 56 on the sub-deck 6. The seals 120 do not need to make the space between the footrests 118 and the gunnels 56 watertight since any water that enters in the side channels 84 located below can be evacuated through the rear channel 94. The seals 120 are there to prevent objects from falling through that space and then falling in the side channels 84, which would make these objects difficult to recover without removing the deck 8. Since an upper end of the side channels 84 is wider than a lower end of the side channels 84, the seals 120 are preferably made of a flexible material, such as rubber or plastic, that can compress and expand to follow the inner side of the gunnels 56 as the HSD assembly moves relative to the deck 8. The seals 120 will be described below in further detail. The footrests 118 are preferably covered by carpeting made of a rubber-type material to provide additional comfort and feet traction.

As best seen in FIGS. 2 and 5, the helm assembly 46 is positioned forwardly of the straddle-type seat 108. As previously mentioned, the helm assembly 46 is used to turn the steering nozzle 44, and therefore the watercraft 2. The helm assembly 46 has a central helm portion 122, that may be padded, and a pair of steering handles 124. The right steering handle 124 is provided with a throttle lever 126 allowing the driver to control the speed of the watercraft 2. The left steering handle is provided with a lever 50 to control the position of the reverse gate 48, as previously mentioned. The central helm portion 122 has buttons 128 that allow the driver to modify what is displayed (such as speed, engine rpm, and time) on the display cluster 130 located forwardly of the helm assembly 46. Additional buttons 132 are provided on the helm portion 122 to allow the driver to adjust the force absorption characteristics of the suspension elements 70. The helm assembly 46 is also provided with a key receiving post 134 near a center thereof. The key receiving post 134 is adapted to receive a key (not shown) attached to a lanyard (not shown) so as to allow starting of the watercraft 2. It should be noted that the key receiving post 134 may alternatively be placed in any suitable location on the watercraft 2. The helm assembly 46 is preferably pivotable about a horizontal axis to allow the height of the helm assembly 46 to be adjusted to suit the driver's preference. The display cluster 130 also preferably moves about the horizontal axis with the helm assembly 46.

The deck 8 is provided with a hood 136 located forwardly of the helm assembly 46. A hinge (not shown) is attached between a forward portion of the hood 136 and the deck 8 to allow hood 136 to move to an opened position to provide access to a front storage bin (not shown). A latch (not shown) located at a rearward portion of hood 136 locks hood 136 into a closed position. When in the closed position, hood 136 prevents access to the front storage bin. Rearview mirrors 138 are positioned on either side of hood 136 to allow the driver to see behind the watercraft 2 while driving.

Figure 13:
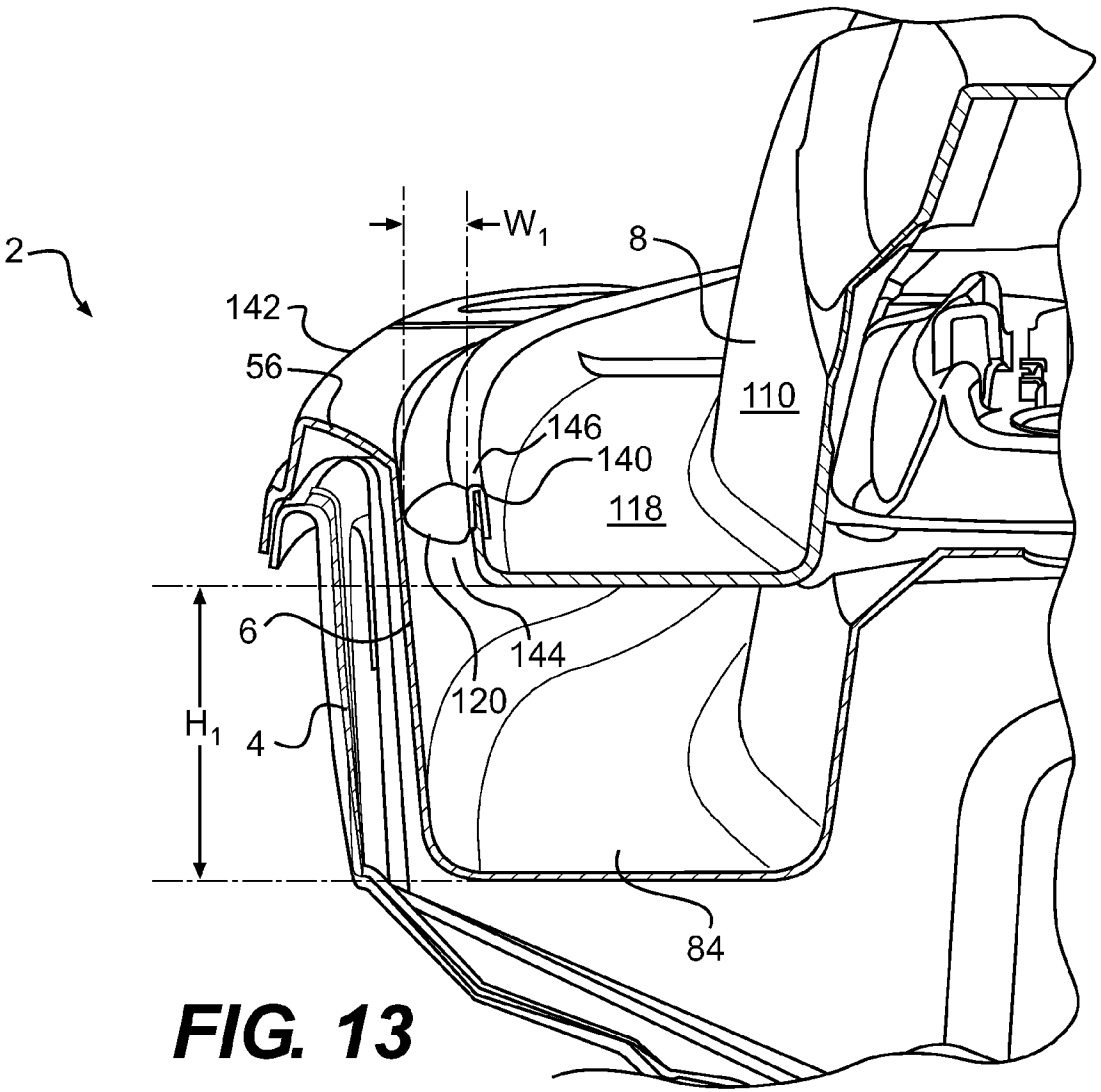
FIGS. 13 and 14 are partial transverse cross-sections of the watercraft of FIG. 1, showing the deck at different heights relative to the hull and sub-deck assembly.
Figure 14:
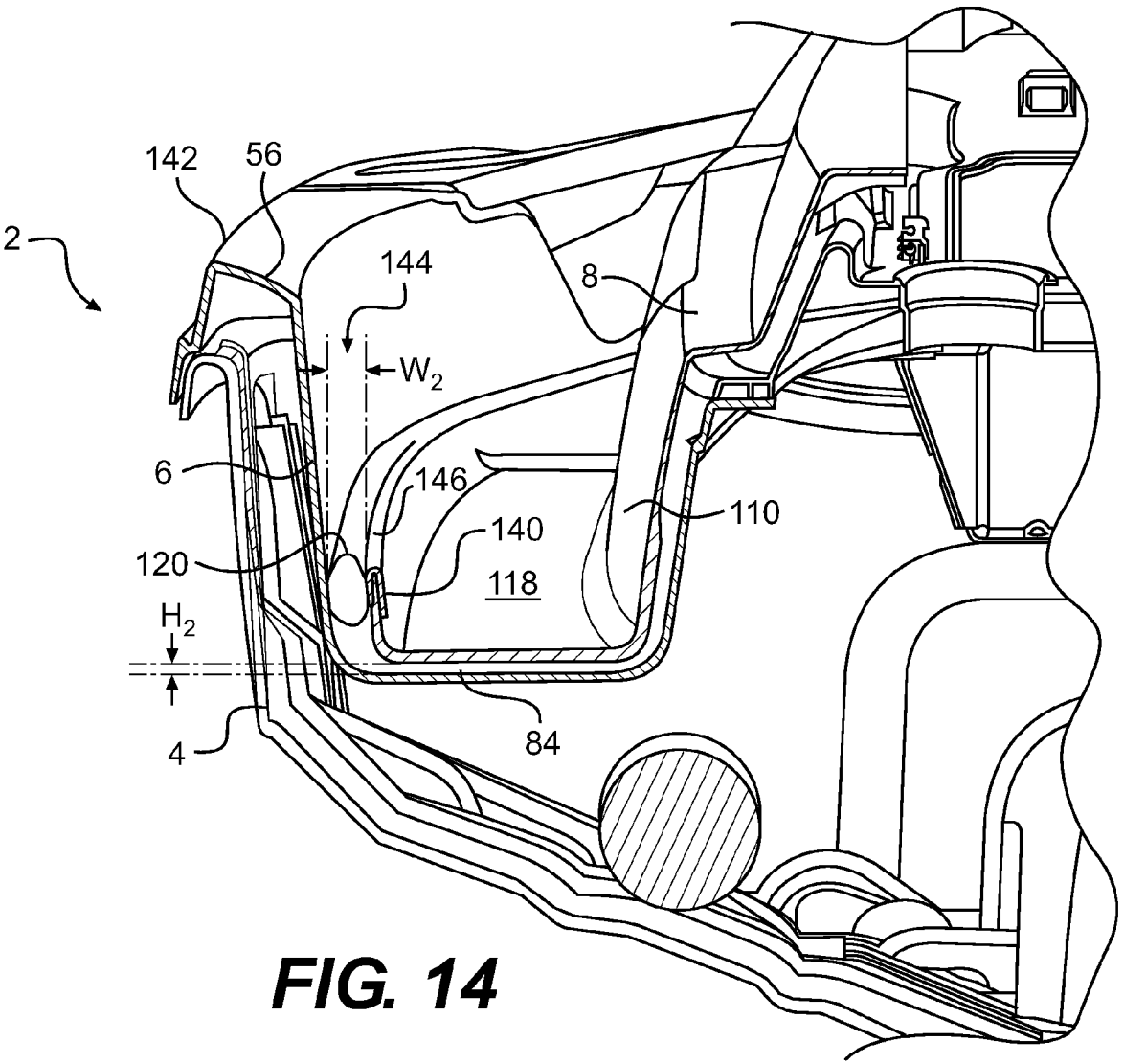

Turning to FIGS. 13 and 14, the seals 120 will now be described. The operation of the seal 120 will be described with respect to a watercraft 2 in which the deck 8 is suspended on the HSD assembly and movable with respect thereto. The seal 120 will be described with reference to the left side of the watercraft 2. The seal 120 on the right side of the watercraft 2 operates in a similar fashion and will not be described in detail. It should additionally be understood that the seals 120 would function similarly on a watercraft 2 in which the deck 8 is fixedly connected to the HSD assembly.

Figure 16:
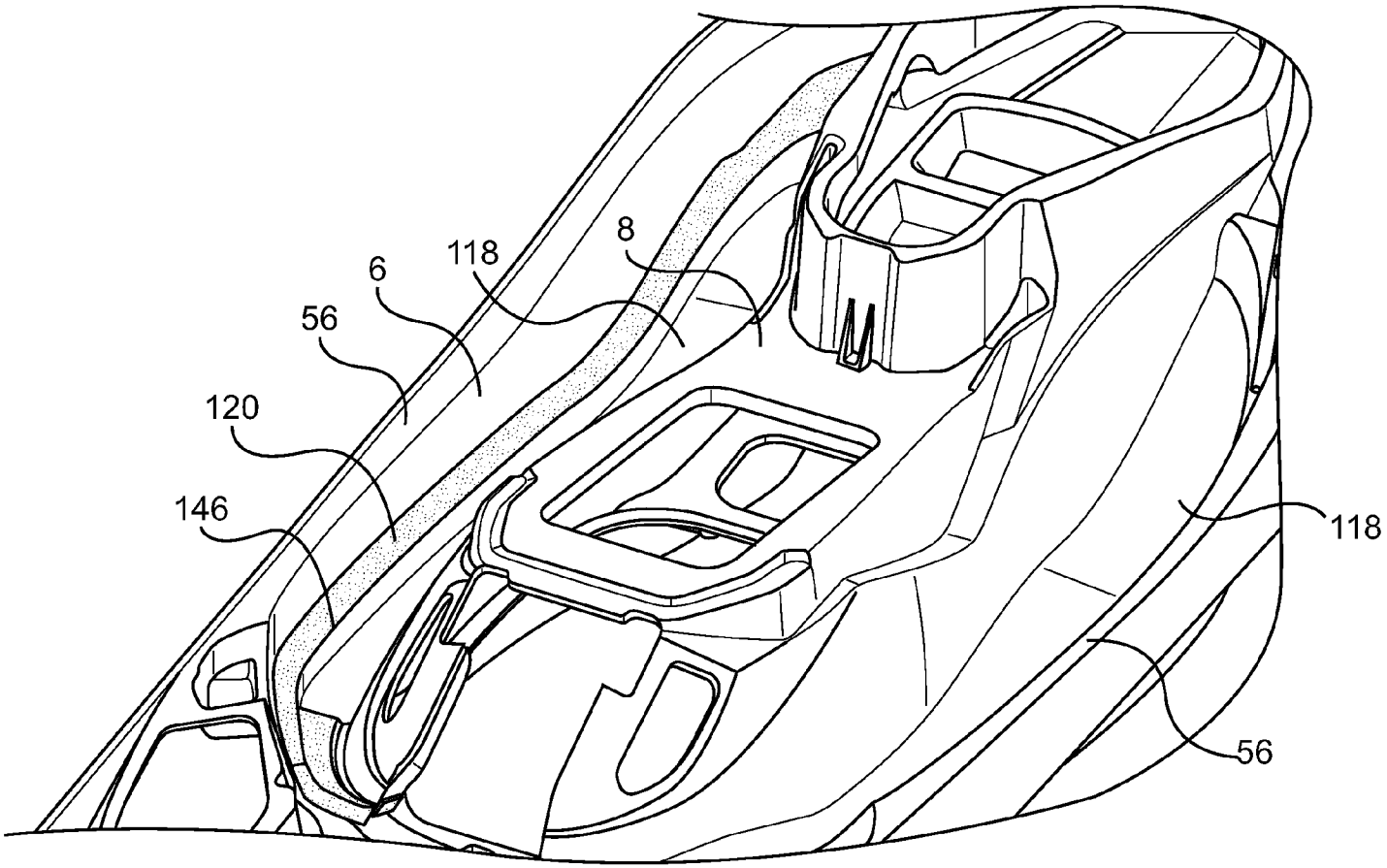
FIG. 16 is a partial perspective view, taken from a rear, right side, of the deck and sub-deck of the watercraft of FIG. 1.

Referring to FIG. 13, a portion of the watercraft 2 is shown with the deck 8 in a raised position relative to the HSD assembly. In the raised position, the deck is disposed above the HSD assembly by a height H1. The lateral edge 140 of the deck 8 is disposed laterally outwardly of the pedestal 110 and the footrest 118. Both the lateral edge 140 and the footrest 118 are disposed lower than the upper edge 142 of the gunnel 56. It is contemplated that the lateral edge 140 may alternatively be the outermost portion of the footrest 118, and need not be a separate structural component such as the upturned lip shown in FIG. 13. A gap 144, having width W1, is defined between the lateral edge 140 of the deck 8 and the gunnel 56. As can also be seen in FIG. 16, the seal 120 is attached to the lateral edge 140 of the deck 8 and extends toward the gunnel 56. The outer edge of the seal 120 is in contact with the gunnel 56. It is contemplated that the deck 8 may be movable to a position higher than the raised position shown in FIG. 13, and in this higher position the seal 120 may not be in contact with the gunnel 56, as long as the separation between the seal 120 and the gunnel 56 is not large enough to permit small objects to pass therethrough. As can best be seen in FIG. 5, the footrest 118 extends longitudinally farther than the seat 108, and the seal 120 extends longitudinally substantially along the entire length of the footrest 118.

Referring now to FIG. 14, the deck 8 is in a lowered position relative to the HSD assembly. In the lowered position, the deck is disposed above the HSD assembly by a height H2 that is smaller than the height H1. Both the lateral edge 140 and the footrest 118 remain disposed lower than the upper edge 142 of the gunnel 56. In this position, the gap 144 has a width W2 smaller than the width W1. Because the width of the gap 144 is decreased, the seal 120 is compressed between the lateral edge 140 of the deck 8 and the gunnel 56. The outer edge of the seal 120 thus remains in contact with the gunnel 56.

The seal 120 is preferably made of an elastomeric material, or thermoplastic rubber, that can compress and expand in response to external stresses. The seal 120 may be manufactured as a co-extrusion with an attachment member 146 made of a harder material, in which case the attachment member 146 is used to attach the seal 120 to the deck 8. The seal 120 may alternatively be manufactured as a single extrusion of the seal material. It is further contemplated that the seal 120 may be manufactured in a series of shorter lengths that are either assembled to form a single seal 120 prior to attachment to the deck 8, or separately attached to the deck 8 adjacently to each other to form the seal 120, in which case each length may optionally have a different cross-sectional shape. The seal 120 is dimensioned to contact the gunnel 56 when the deck 8 is in the raised position. The seal 120 compresses as the deck 8 moves toward the lowered position and the width of the gap 144 decreases from W1 to W2. The outer edge of the seal 120 follows the gunnel 56 as the deck 8 moves from the raised position to the lowered position relative to the HSD assembly, and remains in contact therewith.

Figure 15:
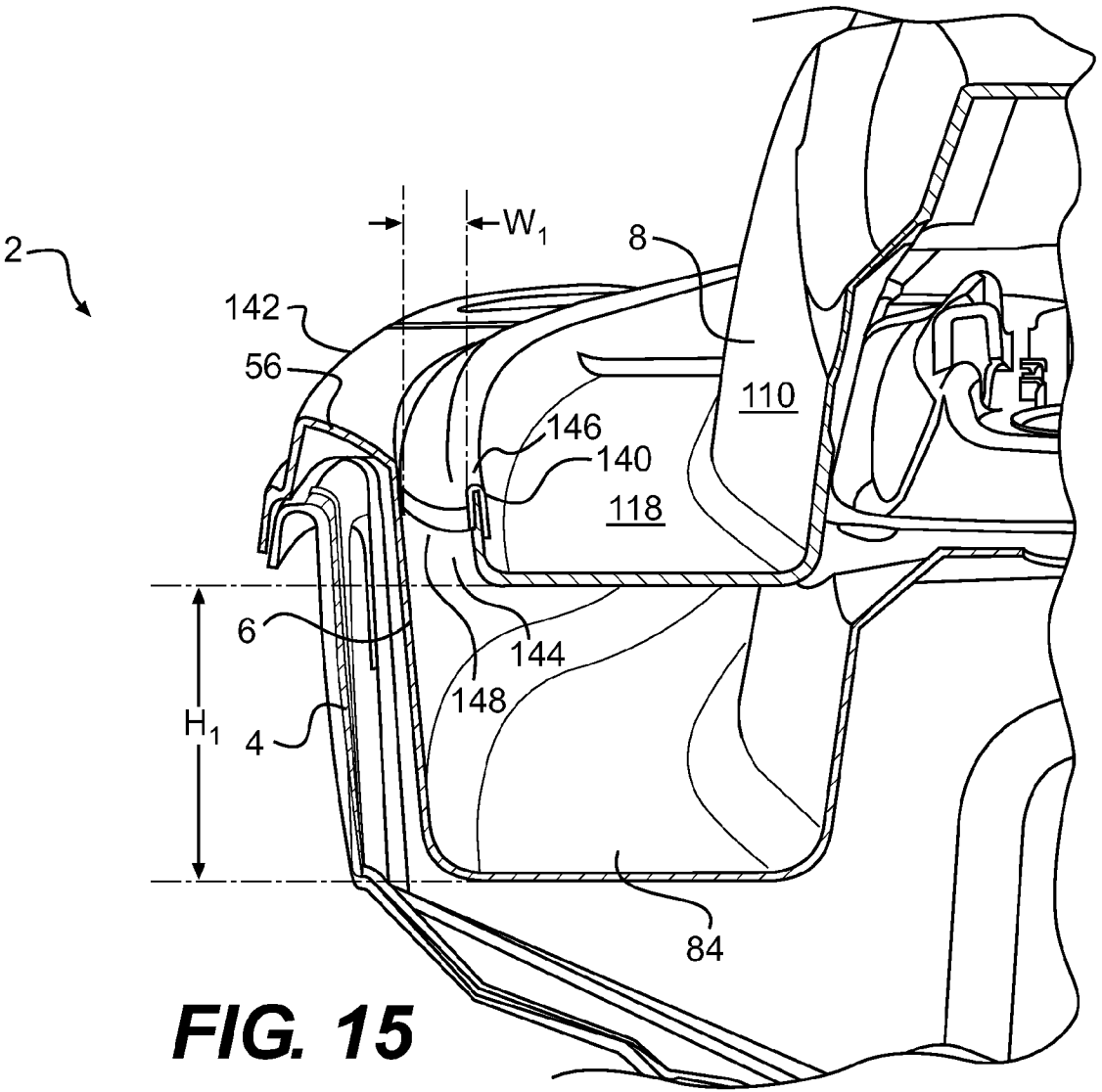
FIG. 15 is a partial transverse cross-section of the watercraft of FIG. 1, showing the seal according to an alternative embodiment.

It is contemplated that the seal 120 may have a different cross-sectional shape from the one shown in FIGS. 13 and 14 without departing from the scope of the invention, such as the seal 148 shown in FIG. 15, as long as the friction generated between the seal 120 and the gunnel 56 is minimized when the deck 8 moves relative to the HSD assembly and the chance of objects falling between the deck 8 and the HSD is minimized.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A personal watercraft comprising:

a hull;

a sub-deck disposed on the hull, the hull and sub-deck together forming a hull and sub-deck (HSD) assembly;

the HSD assembly having upwardly-extending left and right gunnels, each gunnel having an upper end;

an engine disposed in the HSD assembly;

a propulsion system connected to the hull and operatively connected to the engine;

a helm assembly operatively connected to the propulsion system;

a deck disposed above the sub-deck, the deck having:

a pedestal;

a straddle-type seat disposed on the pedestal at least in part rearwardly of the helm assembly;

left and right lateral edges disposed laterally outwardly of the pedestal, the left and right lateral edges being disposed vertically at least as low as the upper end of the left and right gunnels, the left lateral edge and the left gunnel defining a left gap therebetween, the right lateral edge and the right gunnel defining a right gap therebetween;

a left seal member extending laterally outwardly from the left lateral edge, the left seal member extending into the left gap generally toward the left gunnel; and a right seal member extending laterally outwardly from the right lateral edge, the right seal member extending into the right gap generally toward the right gunnel.

2. The personal watercraft of claim 1, wherein the deck also has a left footrest disposed laterally outwardly of the pedestal and laterally inwardly of the left lateral edge; and a right footrest disposed laterally outwardly of the pedestal and laterally inwardly of the right lateral edge; and wherein the left and right footrests are vertically lower than the upper ends of the left and right gunnels.

3. The personal watercraft of claim 2, wherein the left and right footrests extend longitudinally at least the length of the seat.

4. The personal watercraft of claim 2, wherein the left seal member extends substantially along an entire length of the left footrest, and the right seal member extends substantially along an entire length of the right footrest.

5. The personal watercraft of claim 1, further comprising a suspension element having a first portion connected to the deck and a second portion connected to the HSD assembly, the suspension element permitting relative movement between the deck and the HSD assembly, the HSD assembly being movable relative to the deck between a first position in which the HSD assembly is disposed a first distance below the deck and a second position in which the HSD assembly is disposed a second distance below the deck, the second distance being smaller than the first distance, such that the left and right lateral edges are disposed vertically at least as low as the upper end of the left and right gunnels when the HSD assembly is in the first and second positions.

6. The personal watercraft of claim 5, wherein:

the left gap has a first width when the HSD assembly is in the first position, the left gap has a second width when the HSD assembly is in the second position, the second width being smaller than the first width, the right gap has a third width when the HSD assembly is in the first position, and the right gap has a fourth width when the HSD assembly is in the second position, the fourth width being smaller than the third width.

7. The personal watercraft of claim 6, wherein when the HSD assembly is in the second position:

an outer portion of the left seal member is in contact with the left gunnel; and an outer portion of the right seal member is in contact with the right gunnel.

8. The personal watercraft of claim 7, wherein when the HSD assembly is in the first position:

an outer portion of the left seal member is in contact with the left gunnel; and an outer portion of the right seal member is in contact with the right gunnel.

9. The personal watercraft of claim 8, wherein the outer portion of the left seal member follows an inner side of the left gunnel as the HSD assembly moves between the first position and the second position; and wherein the outer portion of the right seal member follows an inner side of the right gunnel as the HSD assembly moves between the first position and the second position.

10. The personal watercraft of claim 1, wherein the left and right seal members contain an elastomeric material.

11. The personal watercraft of claim 10, wherein the left and right seal members contain thermoplastic rubber.

* * * * *